US005920935A

United States Patent [19]

Beck

[11] Patent Number: 5,920,935

[45] Date of Patent: Jul. 13, 1999

[54] COMBINATION HAND TOOL

[75] Inventor: Martin E. Beck, Manhattan Beach, Calif.

[73] Assignee: Spyderco, Inc., Golden, Colo.

[21] Appl. No.: 09/010,734

[22] Filed: Jan. 22, 1998

[51] Int. Cl.[6] ..... B25B 7/22; B25B 13/00; B25B 13/10; B26B 11/00

[52] U.S. Cl. ..... 7/128; 7/125; 7/127; 7/132; 7/138; 7/139; 7/142; 7/158

[58] Field of Search ..... 7/125, 127, 128, 7/129, 130, 131, 132, 133, 134, 135, 138, 139, 142, 158

[56] References Cited

U.S. PATENT DOCUMENTS

| | | | |
|---|---|---|---|
| 1,321,777 | 11/1919 | Stepanian . | |
| 4,512,051 | 4/1985 | Magan | 7/128 |
| 4,967,435 | 11/1990 | Seals | 7/139 |
| 4,995,128 | 2/1991 | Montgomery et al. | 7/127 |
| 5,029,354 | 7/1991 | Boyd, Jr. et al. | 7/118 |
| 5,033,140 | 7/1991 | Chen et al. | 7/127 |
| 5,119,520 | 6/1992 | Finn | 7/127 |
| 5,303,439 | 4/1994 | Seals | 7/138 |
| 5,432,968 | 7/1995 | Beck | 7/128 |

OTHER PUBLICATIONS

Home Improvement Market, vol. 235, No. 1, pp. 15 and 44, Jan. 1998.

The Knife Center of the Internet, Internet Catalog Web page, 1996.

*Primary Examiner*—David A. Scherbel
*Assistant Examiner*—Philip J. Hoffmann
*Attorney, Agent, or Firm*—Sheridan Ross P.C.

[57] ABSTRACT

The present invention relates to compact tools, and more specifically hand tools which have various interconnectable implements for performing numerous functions. In one aspect of the present invention the combined tool has opposing handles which may be used in at least 3 distinct positions to increase the versatility of the tool, as well as the ability of the opposing handles being alternated between various positions of use with only the use of one hand.

44 Claims, 11 Drawing Sheets

COMBINATION HAND TOOL

FIELD OF THE INVENTION

The present invention relates to hand tools, and more specifically compact hand tools which have a multiplicity of implements for use in a variety of applications.

BACKGROUND OF THE INVENTION

Hand tools are commonly used by craftsmen, mechanics, and homeowners during the assembly, construction and/or repair of items ranging from large commercial buildings and automobiles to children's toys. Based on the almost endless uses for hand tools there are literally thousands of different variations of tools designed for specific trades or applications. Unfortunately, it is both expensive, impractical and extremely burdensome for craftsmen or homeowners to either own every type of tool or carry a multitude of hand tools on a job site due to their combined weight and burdensome nature.

To address the aforementioned problems associated with craftsmen and homeowners carrying a multitude of individual hand tools, "combination" hand tools have been designed which have numerous implements on one given tool, thus making the tool applicable for a variety of uses. The most common implements found on combination hand tools include pliers, knives, can openers, awls, bottle openers and other tools. Unfortunately, many of these tools are not commonly used in the trades and are not constructed in a durable manner conducive to heavy use by craftsman or mechanics.

Additionally, many combination hand tools are not designed in a manner which facilitates the opening and closing of the tool with one hand, and thus are impractical to use when attempting to hold an object with another hand. This is especially true when attempting to use a sharp knife blade, which in most combination hand tools cannot be opened with one hand while the combination tool is in a normal position of use, thus making the tool quite impractical. Further, due to the relatively small length of most combination hand tools, there is a problem with reduced torque and leverage while using many of the tool implements. Finally, typical combination hand tools cannot be disassembled to facilitate using two or more implements simultaneously, such as a screwdriver and a wrench.

SUMMARY OF THE INVENTION

It is thus an object of the present invention to provide a combination hand tool which is compact in size yet contains a multiplicity of implements which can provide a variety of functions. In one aspect of the invention the combination hand tool has implements including multiple screwdrivers, a crescent wrench, pliers, a folding knife, wirecutters, and a file.

It is yet another object of the present invention to provide a combination hand tool which has extendable handles which permit the total length of the hand tool to be lengthened. This additional handle length provides substantially more leverage and torque than conventional combination hand tools. In one aspect of the present invention the opposing handles are pivotally interconnected by means of a stud pivot pin which permits a second handle to rotate arcuately about the stud in a plane which is substantially parallel to a first handle. When the second handle is rotated and extended, the opposing first and second handles become substantially linear as one common handle, thus providing significantly more length to provide torque and leverage during use of a wrench, screwdriver or other type of tool implement. Preferably, a locking mechanism is provided to secure the opposing handles in the extended position until such time as the handles are desired to be released to their original first position of use.

It is yet another object of the present invention to provide a combination hand tool which can be opened and closed between a first position of use and a second position of use with one hand, thus allowing a user to use his other hand for other purposes. This is accomplished by providing a release mechanism positioned on the first or second handle which can be engaged by a user's thumb or forefinger to allow the second handle to rotate about the stud pivot to the second extended position of use.

It is yet another object of the present invention to provide a compact combination hand tool with operating handles which can be readily disconnected and reassembled quickly and efficiently. This feature allows tool implements interconnected to each of the handles to be used simultaneously, such as a screwdriver and a wrench. Thus, in one aspect of the present invention a first handle has an interconnected implement capable of holding a variety of screwdriver attachments and a second handle portion comprising an adjustable crescent wrench or other similar tool implement.

In yet another aspect of the present invention a knife blade or other type of tool implement is provided which is pivotally interconnected to the first and second handle at the same common point of rotation, i.e., the stud pivot. This design facilitates opening the knife blade with one hand, thus allowing the user of the tool to have a free hand for other purposes. Additionally, with the first and second handles in a first position of use, a comfortable and durable knife handle is provided for heavy use of knife blade.

DETAILED DESCRIPTION OF THE PREFERRED EMBODIMENT

Figure 1:
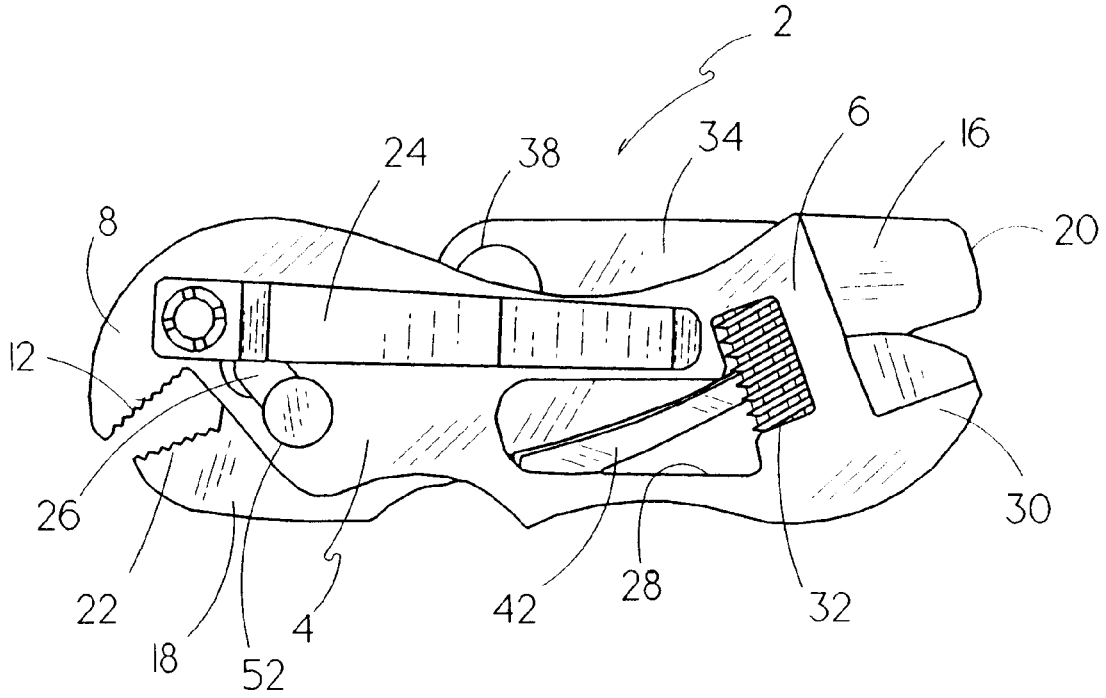
FIG. 1 is a front elevation view of the combination hand tool showing the first and second handles in a first position of use.

Referring now to the drawings, FIG. 1 depicts a front elevation view of the present invention. In general, the combination hand tool 2 is comprised of a first handle 4 and second handle 14 which are interconnected by a stud pivot pin 52. The first handle 4 is generally comprised of a first handle first end 6 and a first handle second end 8. The first handle first end 6 generally has an interconnected first tool implement 10 such as a wrench 30. The first handle second end generally has a first jaw member 12 which is operatively opposed to a second jaw member 22 on the second handle second end 18.

The second handle 14 is generally comprised of a second handle first end 16 and a second handle second end 18. The second handle second end 18 may include a second tool implement 20 or alternatively no interconnected tool implements. The second handle first end 16 generally comprises a jaw member 22 which is operably opposed to the first handle first jaw member 12 and is used for grasping objects such as bolt heads, screws, nails, nuts, or other devices commonly used by craftsmen and mechanics. Pressure is applied to the object by the user squeezing the first handle 4 and second handle 14 in a direction toward one another.

The first handle 4 and second handle 14 are generally comprised of rigid non brittle materials which are durable and not likely to wear, deflect or break during continual use. Metals and metal alloys such as stainless steel, carbon steel, titanium and aluminum are preferable materials, as are numerous other metals commonly known in the art. Additionally, plastics, fiberglass and other similar materials may also be used which have similar physical properties.

In one embodiment of the present invention, the first handle first end 6 and second handle first end 16 are rotatably interconnected by a stud pivot pin 52. The stud pivot pin 52 passes through a first handle aperture 26 which is provided in the first handle second end 8. Alternatively, the stud pivot pin 52 may be interconnected to the first handle 4 and pass through an aperture on the second handle 14. Alternatively, the stud pivot pin 52 may not be interconnected to either the first handle 4 or second handle 14 but instead may be an independent component. Thus as shown in FIG. 1, the first handle 4 and second handle 14 are pivotally interconnected in a first position of use to allow the first jaw member 12 and second jaw member 22 to be operably opposed for gripping objects.

In an alternative embodiment the first handle 4 and second handle 14 may be interconnected by a ratcheting assembly or other mechanism which allows the handles to be rotated between a first position of use to a second position of use with the handles aligned substantially coextensive with one another. Thus, numerous other types of mechanical devices may be used to interconnect the first handle 4 and second handle 14 without the use of a stud pivot pin 52 or other similar mechanism.

Figure 2:
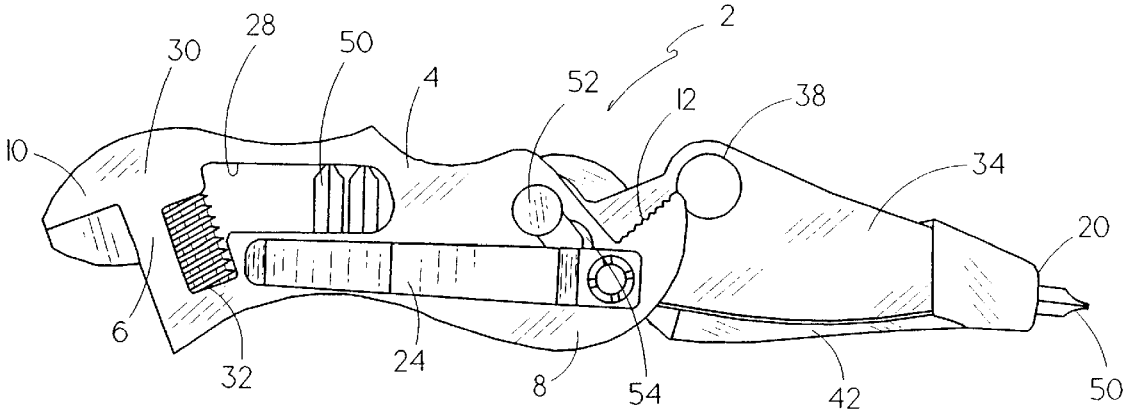
FIG. 2 is a front elevation view of the combination hand tool showing the first and second handle portions in a second extended position of use.

Referring now to FIG. 2, the combination hand tool 2 is shown in a second position of use. In the second position of use the second handle 14 is aligned substantially coextensive with the first handle 4 to create a hand tool of significantly more length than the hand tool shown in FIG. 1. The extended length of the combination hand tool 2 provides additional leverage for using the wrench 30 or other type of tool implement which may be interconnected on the first handle first end 6, or the second handle second end 18.

Preferably, the wrench 36 has a wrench adjustment screw 32 which can be used to adjust the opening direction of the wrench and to tighten the wrench about an object. Additionally, a gauge or other form of measuring scale may be inscribed or marked on the wrench to determine the dimension of the wrench opening.

Preferably, a second tool implement 20 may be interconnected to the second handle second end 18 which comprises a recess with a geometric configuration adapted to receive a screwdriver bit 50 or other form of tool implement such as a socket, awl, bottle opener, or any other type of tool commonly used by craftsmen, mechanics or homeowners. Thus in the second extended position shown in FIG. 2, additional leverage can be provided to the second tool implement 20 just as additional leverage may be applied to the first tool implement 10 depending on which end of the combination hand tool 2 the user is grasping.

To facilitate the movement of the hand tool between the first position of use shown in FIG. 1 and the second extended position of use shown in FIG. 2, a handle release/locking mechanism 44 may be provided as shown in FIGS. 5–6 and FIGS. 8–11. In one embodiment, the handle release/locking mechanism 44 is operatively placed in a position proximate to a user's thumb to allow the combination hand tool to be simultaneously opened and closed between the first position of use and the second position of use by applying pressure to the handle release/locking mechanism 44. The release/locking mechanism 44 may be recessed within the first handle 4 or second handle 14 or be interconnected to an exterior surface of the first handle 4 or second handle 14. Preferably, the release/locking mechanism 44 is biased with a spring or other similar mechanism which keeps a portion of the release/locking mechanism 44 in an upward position to facilitate engagement with a finger or thumb.

In an improved embodiment, the handle release/locking mechanism 44 may be designed to not only release the first handle 4 and the second handle 14 to allow rotation to the second extended position of use, but to additionally lock the second handle 14 to the first handle 4 in the second position of use. This is accomplished in one embodiment by a portion of the release/locking mechanism becoming engaged with the jaw member of the handle which is rotated to a position proximate to the handle release/locking mechanism 44. This handle release/locking mechanism 44 assures that the combination hand tool 2 remains in the second extended position of use until such time as the handle release/locking mechanism 44 is again released to allow the combination hand tool to rotate from the second extended position of use to a first position of use.

As appreciated by one skilled in the art, the handle release/locking mechanism 44 may be any combination of locking devices known in the art. However, in a preferred embodiment of the present invention, the handle release/locking mechanism 44 is positioned on the combination hand tool 2 in a location which facilitates the opening and closing of the first handle 4 and second handle 14 between the first and second position of use with only the use of one hand. Thus, by allowing the combination hand tool 2 to be opened and closed between the first and second positions of use with only one hand, the user of the combination hand tool may use a free hand for other purposes.

To facilitate holding numerous tool implements on the combination hand tool 2, a tool storage receptacle 28 is provided to hold additional tool implements. In the embodiment shown in FIGS. 2–3 and FIGS. 8–11, additional screwdriver bits 50 are inserted into a tool storage receptacle 28 in the first handle 4 to operably hold the screwdriver bits 50 until such time as they are used. The tool storage receptacle 28 may also include one or more magnets or other retaining mechanisms to help prevent the screwdriver bits 50 or other tool implements from being lost until such time as they are needed. As appreciated by one skilled in the art, the tool storage receptacle 28 may hold any variety of tools such as sockets, allen wrenches, or other tool implements preferred by the user of the tool and may be positioned in any numerous locations on the first handle 4 or second handle 14.

Figure 3:
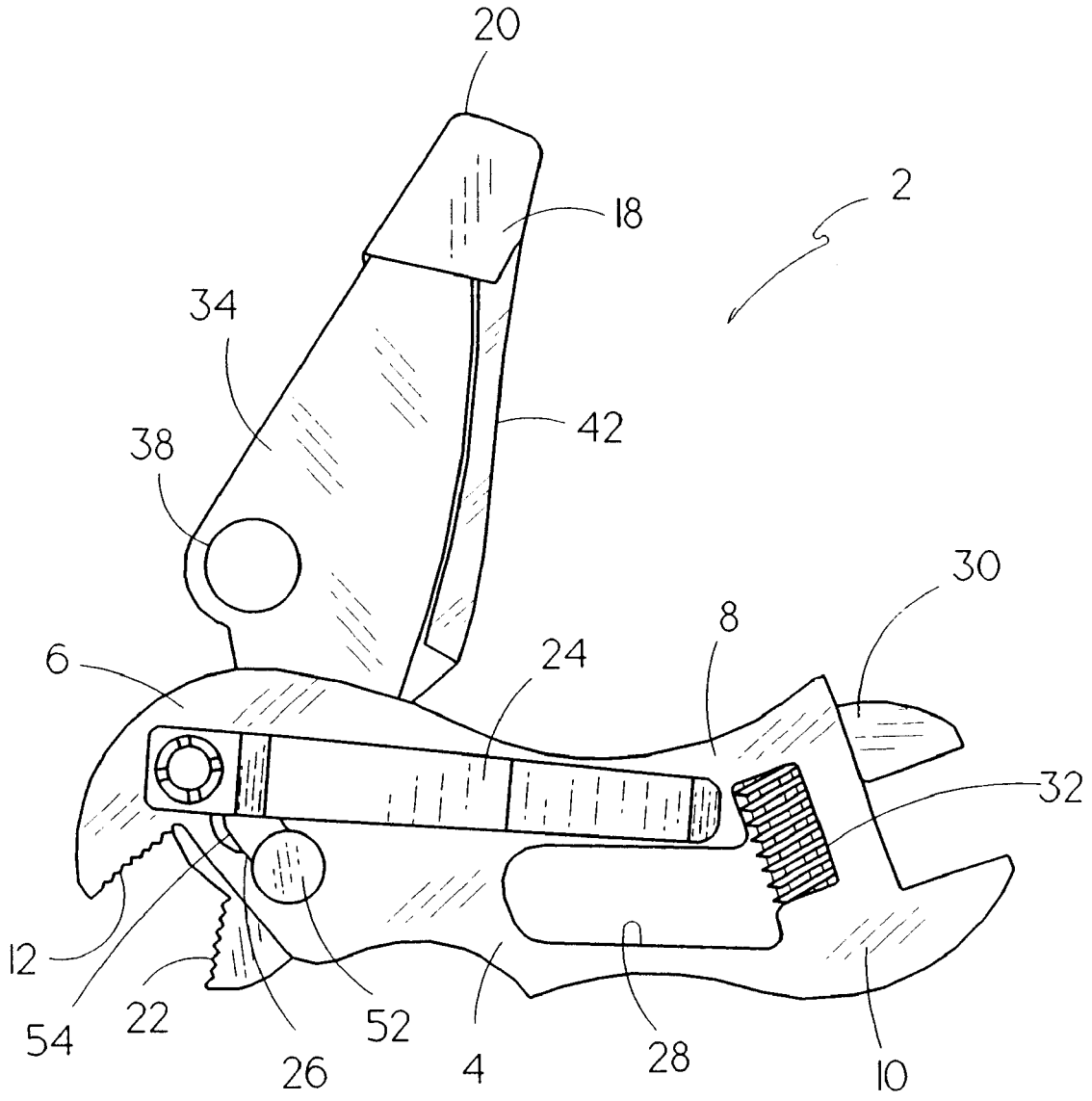
FIG. 3 is a front elevation view of the combination hand tool showing the jaw gripping members opened and the first and second handles rotating between a first and second position of use.

As further depicted in FIGS. 1–3, a clip 24 is provided which is interconnected to either the first handle 4 or the second handle 14. The clip 24 allows the combination hand tool 2 to be interconnected to an object such as a belt or trouser pocket or other similar object to prevent the combination hand tool from becoming misplaced until the time of use and retrieved in a convenient position of user. In a preferred embodiment, the clip is interconnected to the first handle 4 or the second handle 14 by means of a grommet or other mechanism which has an aperture extending entirely through the handles. The aperture allows the insertion of a lanyard, rope, cable, or other similar attachment device which may be used to further secure the combination hand tool to an object to prevent loss.

Figure 4:
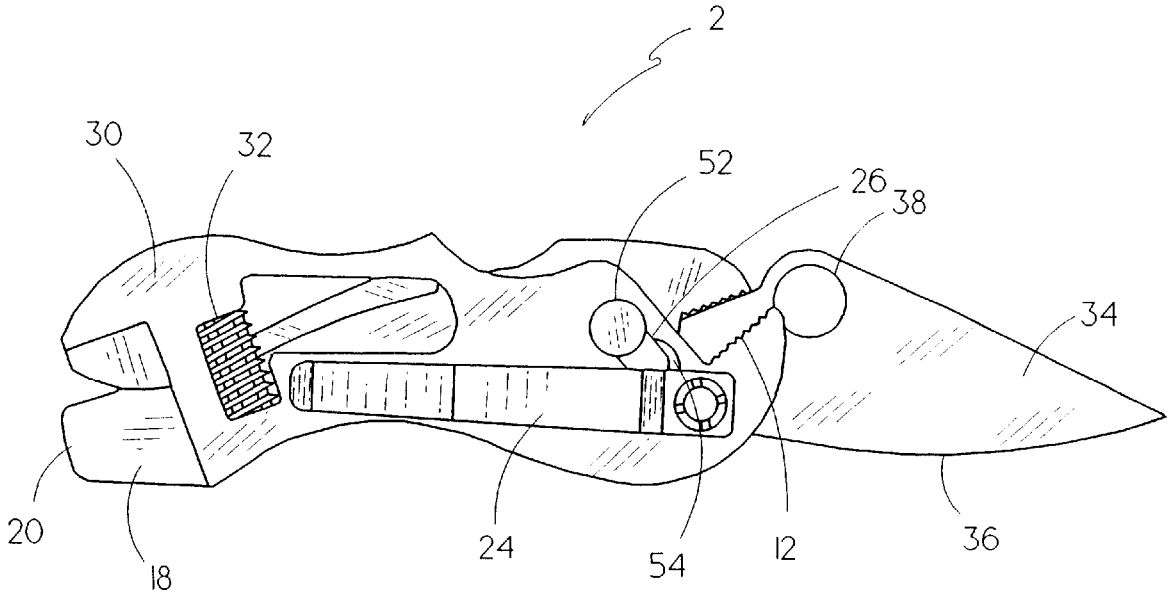
FIG. 4 is a front elevation view of the combination hand tool showing the first and second handles in a first position of use with a knife blade extended for use.

Referring now to FIG. 4, an additional aspect of the present invention is shown wherein a knife blade 34 is pivotally interconnected to the stud pivot pin 52 at the same point of rotation as the first handle 4 and second handle 14. As shown in FIG. 4, with the first handle 4 and second handle 14 in a first position of use, the knife blade 34 may be operably extended to a position of use while the combination hand tool 2 remains in a first position of use. In a preferred embodiment of the present invention, a knife blade thumb depression 38, knife blade thumb stud 40 or knife blade thumb lobe 56 is used to allow the knife blade 34 to be opened with the use of only one hand. A thumb lobe 56 or bent edge positioned near an upper edge of the knife blade 34 may also be used for the same purpose. This allows a user of the combination tool 2 to have a free hand for holding other items during the extension of the knife blade 34.

As further shown in FIGS. 2 and 3, when the knife blade 34 is in an extended position and the combination hand tool 2 is in a second position of use, the knife blade cutting edge 36 is protected from exposure by a second handle blade guard 42. The second handle blade guard 42 prevents the exposure of the knife blade cutting edge 36 and thus the inadvertent danger associated with having an exposed knife blade. Thus the combination hand tool 2 can be safely used in a second position of use with the knife blade extended, or alternatively the second handle 14 may remain in the first position of use while the knife blade 34 is extended for use as a typical knife.

Figure 5:
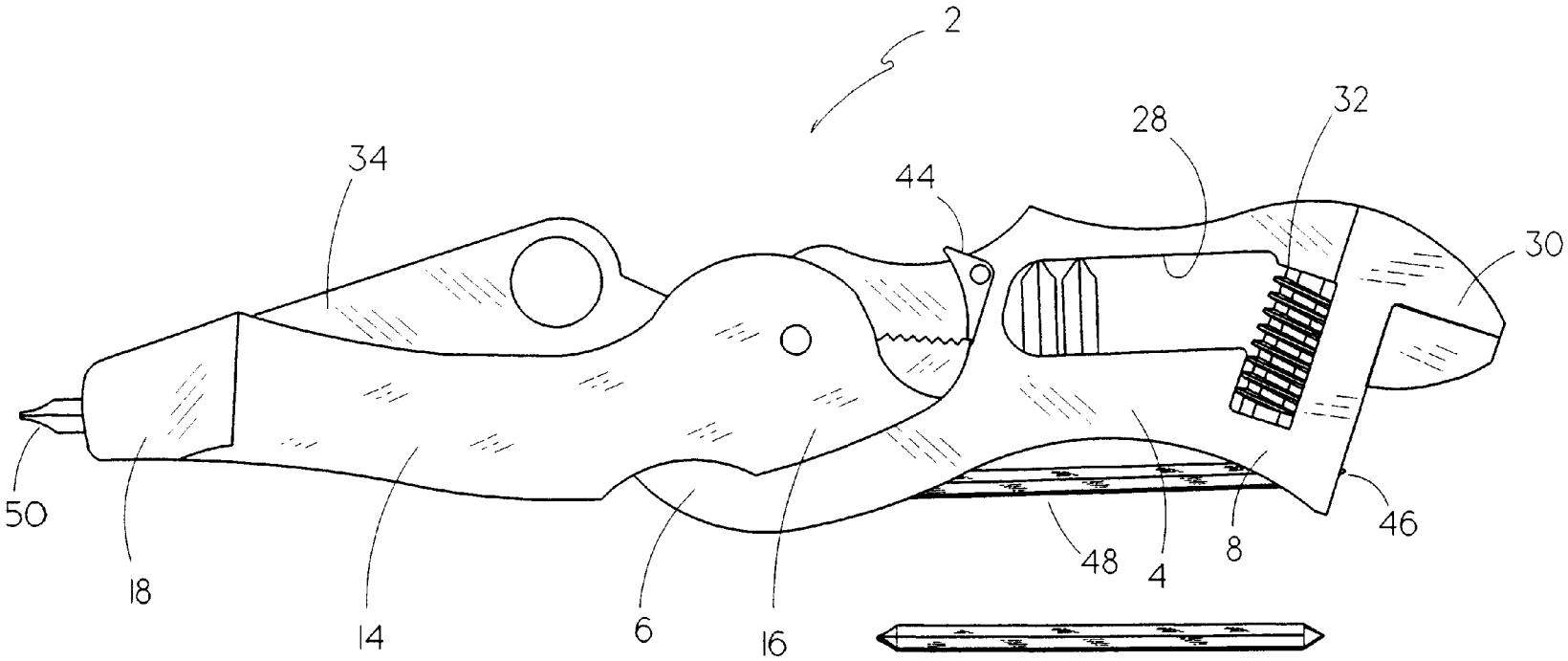
FIG. 5 is a rear elevation view of the combination hand tool showing the handles in a second extended position of use.

Referring now to FIG. 5, a rear elevation view of the combination hand tool 2 is shown with the combination hand tool 2 in a second position of use. As previously mentioned, when the second handle 14 is extended substantially coextensive with the first handle 4, the length of the combination hand tool 2 is significantly increased 2 to provide significantly more leverage when using various tool implements such as the wrench 30. As further seen in FIG. 5, a third tool implement 48 may also be provided which is interconnected to the first handle portion 4. The third tool implement 48 as seen in FIG. 6 may include alternative sizes of screwdriver bits 50 or other tool implements commonly known in the mechanical arts.

In a preferred embodiment of the present invention, the third tool implement 48 is used to facilitate the locking of the first handle 4 and the second handle 14 in a closed position such as seen in FIG. 1. This is accomplished by a handle connection means which allows a portion of the third tool implement 46 such as a handle locking pin 46 to extend slightly beyond the surface of the first handle second end 8. In this position, as the second handle 14 is rotated about the stud pivot pin 52 to a position shown in FIG. 1, the handle locking pin 46 retracts and engages in an aperture or detent in the second handle second end 18.

The handle locking pin 46 is generally biased outwardly by means of a spring or other similar devices commonly known in the art. The handle locking pin 46 is designed to retract inwardly into the first handle second end 8 when pressure is applied to the handle locking pin 46. Alternatively, the handle locking pin 46 could be replaced with a ball detent or other similar device which would retain the first handle 4 and the second handle 14 in a closed position as depicted in FIG. 1 until the user applied enough force to rotate the first handle and second handle about the stud pivot pin 52. Thus, the third tool implement 48 is not necessary for the operation of the tool but rather provides one additional tool implement to be used in combination with the present design. For example, in a preferred embodiment of the present invention, the third tool implement 48 may be inserted into an aperture provided in the second handle second hand 18 to provide additional sizes or shapes of screwdriver bits 50 or other tool implements.

Figure 6:
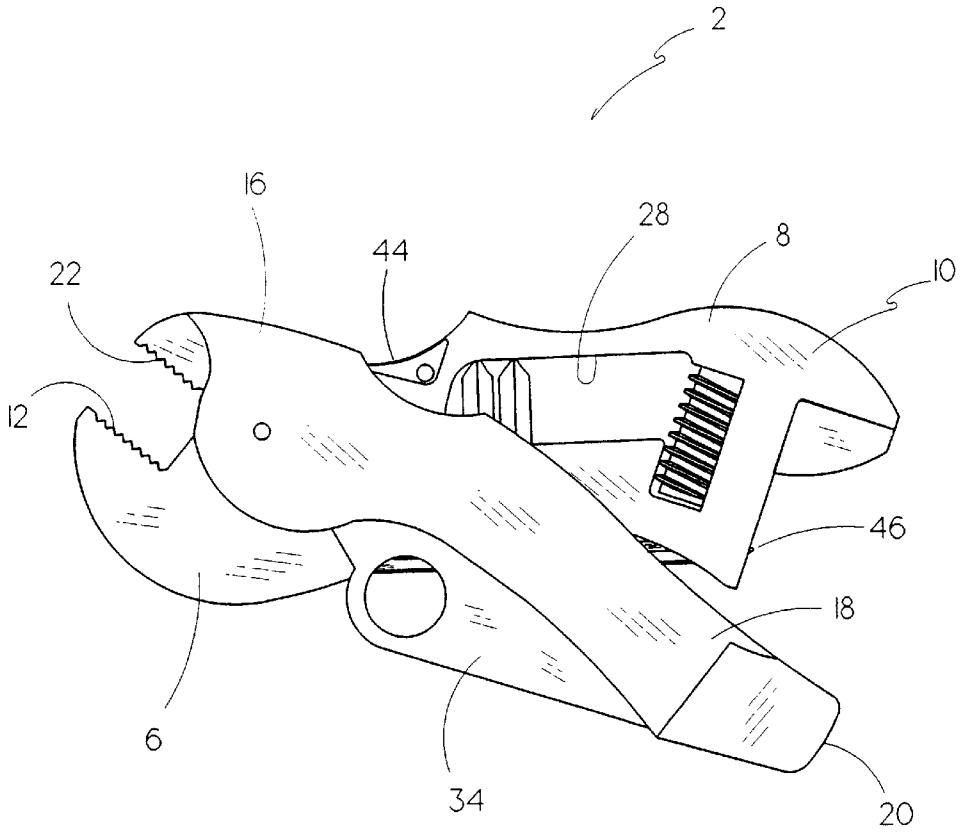
FIG. 6 is a rear elevation view of the combination hand tool showing the handles in a first position of use.

Referring now to FIG. 6, a rear elevation view of the combination hand tool 2 is shown with the first handle 4 and the second handle 14 in a first position of use. However, the handles are slightly rotated from a closed position to allow the grasping of an object between the first jaw member 12 and a second jaw member 22. Additionally, the handle release locking mechanism 44 may be seen in which a preferred embodiment is positioned to allow contact by a user's thumb or forefinger. This allows the handles on the combination hand tool to be reciprocated between a first position of use and a second position of use with one hand. Additionally, as seen in FIG. 6, the handle locking pin 46 or ball detent is shown which is slightly extended from the first handle second end 8. This handle locking pin 46 as previously mentioned engages the second handle second end 18 to operably secure the handles in a closed position when the hand tool is not in use.

Figure 7:
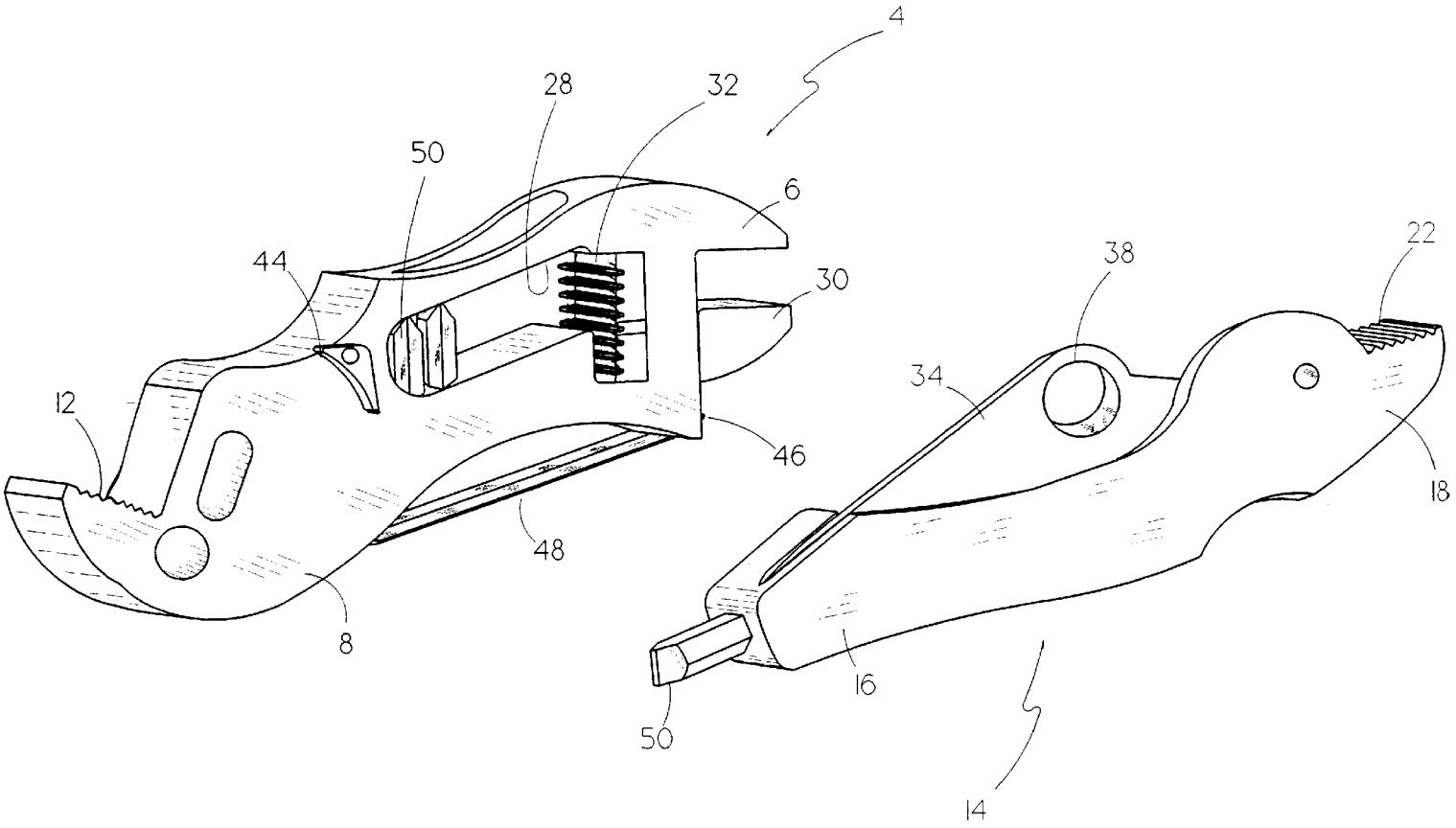
FIG. 7 is a perspective view of the combination hand tool shown in a third position of use with the first and second handles disconnected.

Referring now to FIG. 7, a view of the combination hand tool 2 is shown with the first handle 4 and the second handle 14 disconnected. The opposing handles may be disconnected by means of a release pin as commonly used with traditional socket sets, or by moving the stud pivot pin 52 into the first handle aperture slot 54 to a position which allows the first handle 4 and second handle 14 to be separated. By disconnecting the first handle 4 and second handle 14 it is possible to use each of the two handles independently as tools, such as the wrench 30 and a screwdriver.

Figure 8:
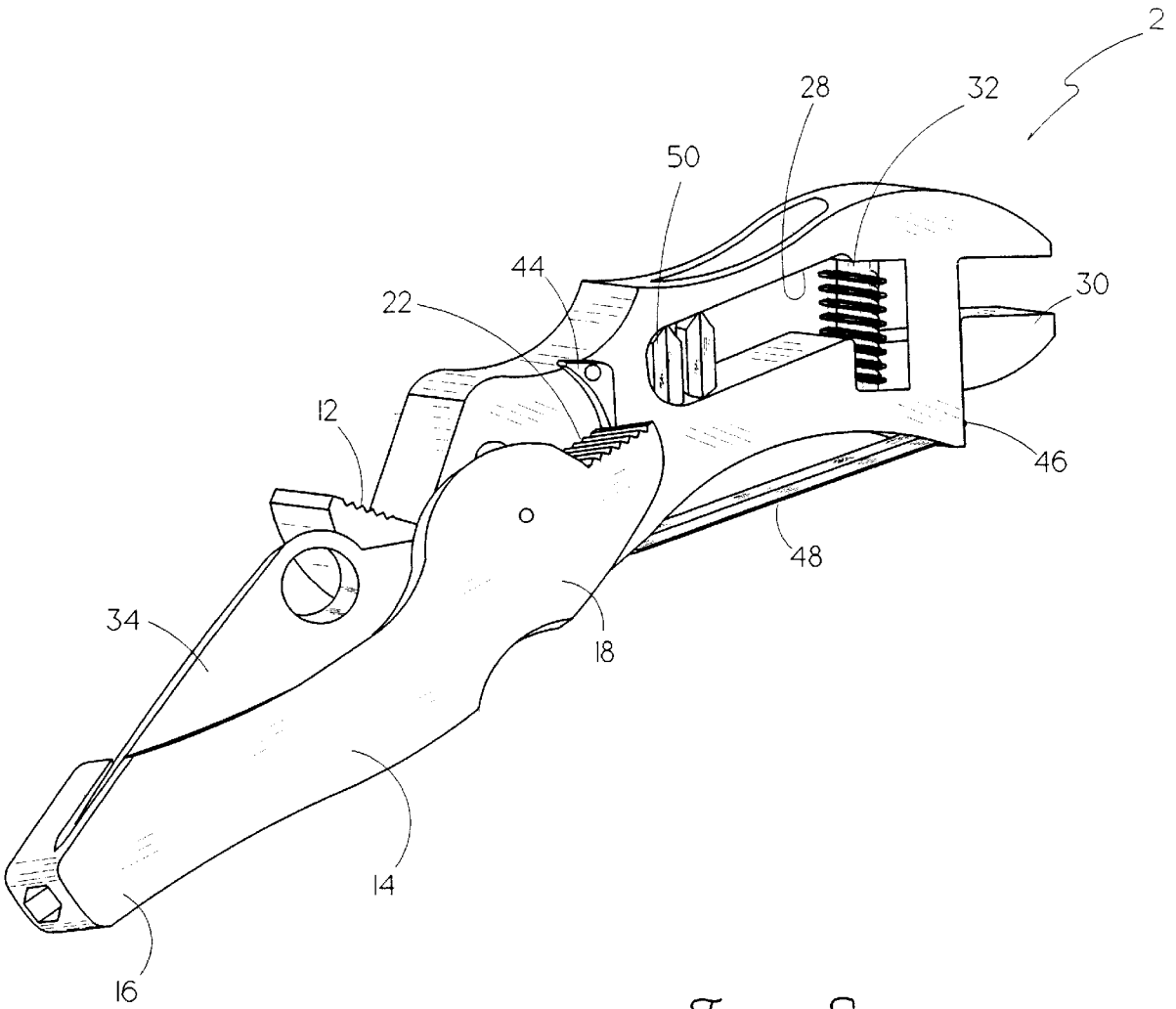
FIG. 8 is a front perspective view of the combination hand tool shown in a second position of use.

Referring now to FIG. 8, a front perspective view of the combination hand tool is seen in a second position of use. As depicted, the handle release/locking mechanism 44 is engaged with the second jaw member 22 to keep the combination hand tool in the second position of use. To release the first handle 4 and second handle 14 and allow the combination hand tool to return to a first position of use, the handle release/locking mechanism 44 is released by pressure being applied by a thumb or finger of the user, thus rotating the handle release/locking mechanism 44 in a counterclockwise direction.

Figure 9:
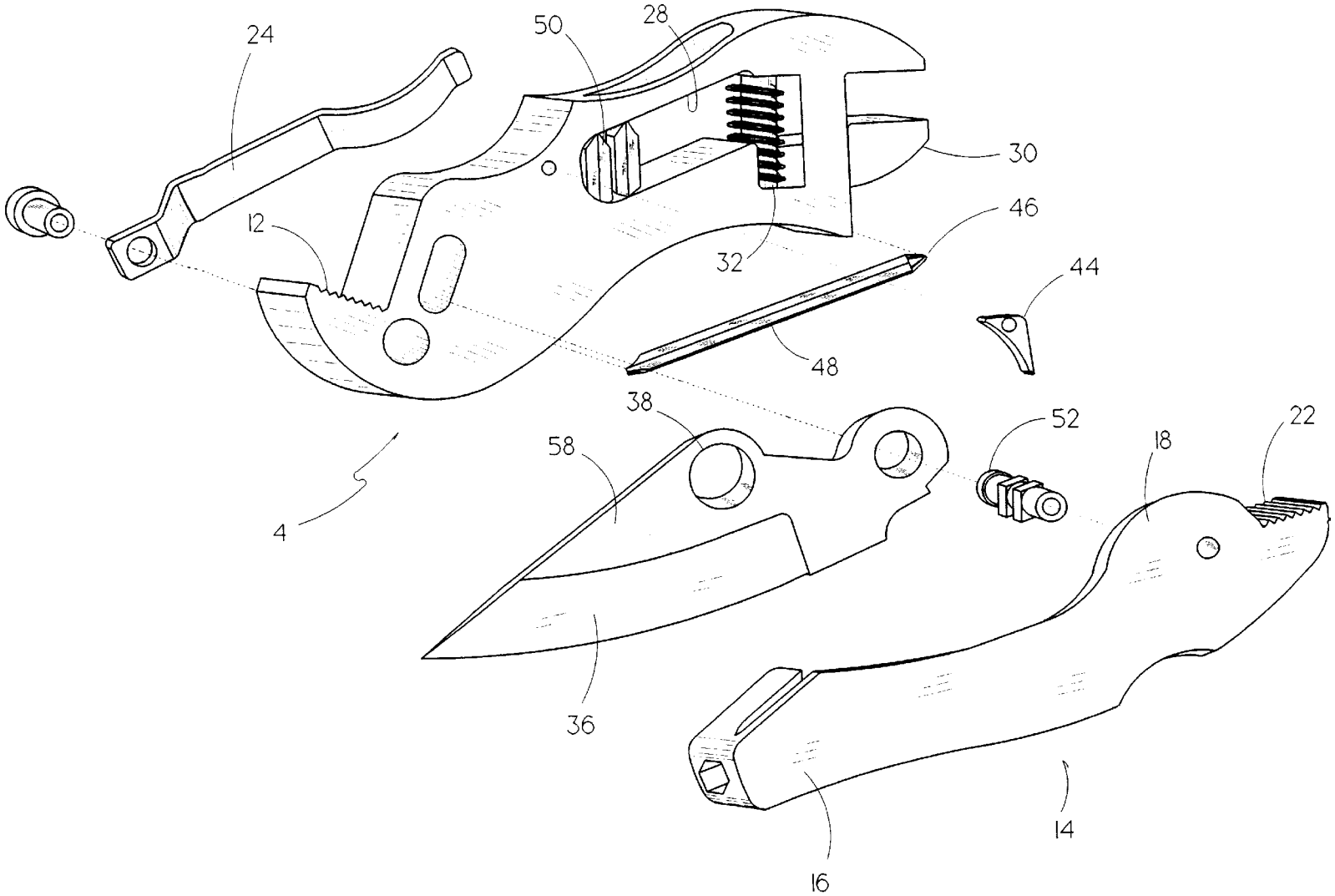
FIG. 9 is an exploded view of the combination hand tool showing the components therein.

Referring now to FIG. 9, an exploded view of the combination hand tool is shown. In this embodiment the stud pivot pin 52 is an independent component pivotally interconnected to the first handle 4, second handle 14 and knife blade 34. Alternatively, the stud pivot pin 52 may be a cast component integrally connected to either the first handle 4 or second handle 14.

Figure 10:
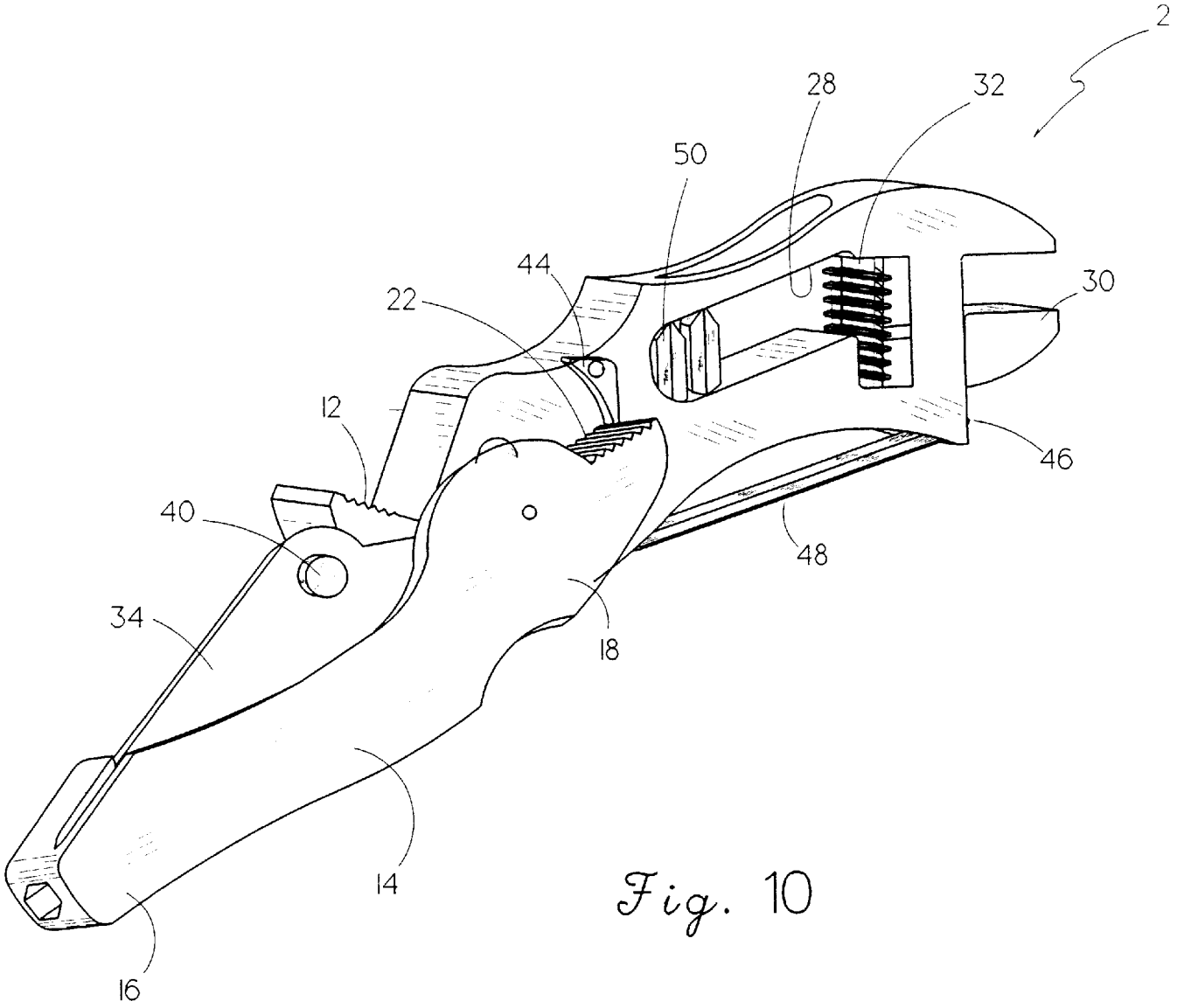
FIG. 10 is a perspective view of the combination hand tool showing a thumb stud on the knife blade to facilitate opening the knife blade with one hand.
Figure 11:
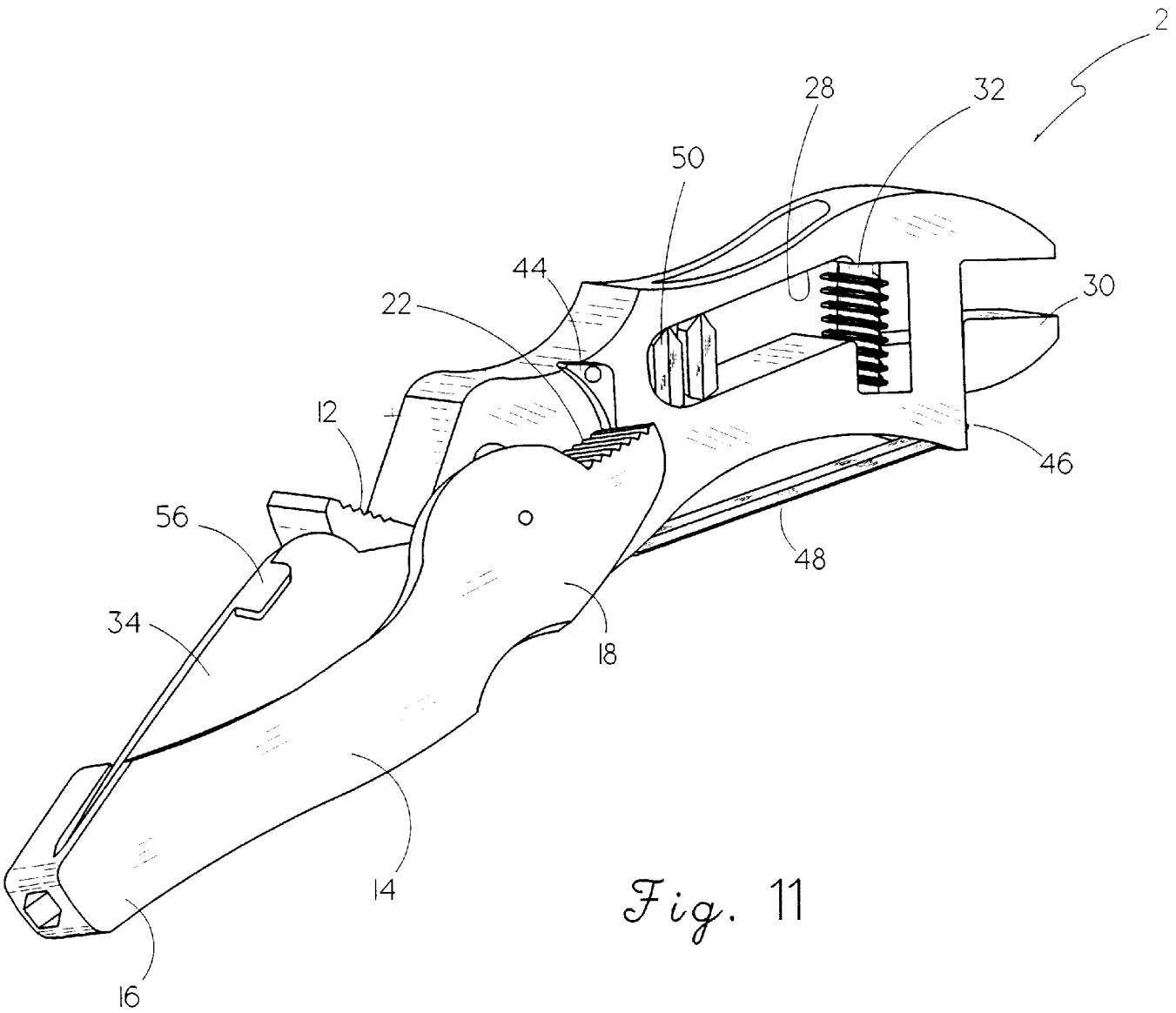
FIG. 11 is a perspective view of the combination hand tool showing a thumb lobe on the knife blade to facilitate opening the knife blade with one hand.

Referring now to FIG. 10, a perspective view of the combination hand tool 2 is shown with an alternative opening mechanism for extending the knife blade. In this embodiment, a knife blade thumb stud 40 is used as opposed to a knife blade thumb depression 38 as shown in the previous drawings. The thumb stud 40 allows the knife blade to be engaged with the thumb or finger of the user of the blade and thus facilitates the opening of the knife blade 34 with one hand. Similarly, FIG. 11 shows a perspective view of the combination hand tool 2 with a thumb lobe 56 as opposed to either a thumb stud 40 or thumb depression 38. The thumb lobe 56 is positioned near an upper edge 58 of the knife blade to again facilitate opening the knife blade 34 with the use of one hand.

For reference purposes only, the following list of components and the numbering used therein in the associated drawings are provided below:

| Component Number | Component |
|---|---|
| 2 | Combination hand tool |
| 4 | First handle |
| 6 | First handle first end |
| 8 | First handle second end |
| 10 | First tool inplement |
| 12 | First jaw member |
| 14 | Second handle |
| 16 | Second handle first end |
| 18 | Second handle second end |
| 20 | Second tool inplement |
| 22 | Second jaw member |
| 24 | Clip |
| 26 | First handle aperture |
| 28 | First handle tool storage receptacle |
| 30 | Wrench |
| 32 | Wrench adjustment screw |
| 34 | Knife blade |
| 36 | Knife blade cutting edge |
| 38 | Knife blade thumb depression |
| 40 | Knife blade thumb stud |
| 42 | Second handle blade guard |
| 44 | handle release/licking mechanism |
| 46 | Handle locking pin |
| 48 | Third tool implement |
| 50 | Screwdriver bits |
| 52 | Stud pivot pin |
| 54 | First handle aperture slot |
| 56 | Knife blade thumb lobe |
| 58 | Knife blade upper edge |

The foregoing description of the present invention has been presented for purposes of illustration and description. Furthermore, the description is not intended to limit the invention to the form disclosed herein. Consequently, variations and modifications commensurate with the above teachings and the skill or knowledge of the relevant art, are within the scope of the present invention. The embodiments described hereinabove are further extended to explain best modes known for practicing the invention and to enable others skilled in the art to utilize the invention in such, or other, embodiments or various modifications required by the particular applications or uses of the present invention. It is intended that the appended claims be construed to include alternative embodiments to the extent permitted by the prior art.

What is claimed is:

1. A combination hand tool, comprising:

a) a first handle having a first end and a second end, said second end having a first jaw member;

b) a second handle having a first end and a second end, said second end having a second jaw member;

c) a pivot means operatively interconnecting said first handle and said second handle, wherein in a first position of use said first and second jaw members are operably opposed for grasping an object, and in a second position of use said second handle is substantially a linear extension of said first handle to increase the overall length of said hand tool; and d) locking means interconnected to said first handle or said second handle for releasably securing said first handle and said second handle in said second position of use, said combination hand tool capable of moving between said first position of use and said second position of use without disconnecting said first handle from said second handle.

2. The combination hand tool of claim 1, wherein said combination hand tool can be opened and closed between said first position of use and said second position of use with the use of only one hand.

3. The combination hand tool of claim 1, wherein said first end of said first handle further comprises a first tool implement.

4. The combination hand tool of claim 3, wherein said first tool implement on said first handle comprises a wrench.

5. The combination hand tool of claim 1, wherein said pivot means comprises a stud interconnected to said second handle proximate to said second jaw member and extending through an aperture in said first handle proximate to said first jaw member.

6. The combination hand tool of claim 1, wherein said first end of said second handle comprises interconnection means for releasably attaching a second tool implement.

7. The combination hand tool of claim 6, wherein said second tool implement is a tool selected from the group consisting of a screwdriver bit, an allen wrench, a socket, a bottle opener or an awl.

8. The combination hand tool of claim 1, further comprising at least one additional handle which is rotatably interconnected to said pivot means, said handle comprising at least one tool implement.

9. The combination hand tool of claim 1, further comprising a knife blade rotatably interconnected to said pivot means.

10. The combination hand tool of claim 9, wherein said knife blade further comprises an aperture positioned proximate to an upper edge of said knife blade, wherein said knife blade may be extended to a position of use with one hand.

11. The combination hand tool of claim 9, wherein said knife blade further comprises a thumb stud positioned proximate to an upper edge of said knife blade, wherein said knife blade may be extended to a position of use with one hand.

12. The combination hand tool of claim 9, wherein said knife blade further comprises a thumb lobe positioned proximate to an upper edge of said knife blade, wherein said knife blade may be extended to a position of use with one hand.

13. The combination hand tool of claim 1, further comprising a clip interconnected to said first handle or said second handle which is adapted for removably interconnecting said combination hand tool to an object such as a belt or trouser pocket.

14. The combination hand tool of claim 1, wherein said first handle and said second handle may be reversibly disconnected and reconnected, wherein said first handle and said second handle may be used independently as distinct tools.

15. The combination hand tool of claim 1, wherein said first handle portion further comprises a tool storage receptacle for releasably storing tool implements.

16. The combination hand tool of claim 1, further comprising handle connection means interconnected to said first handle or said second handle, wherein said first handle and said second handle can be operably secured together with said first handle first end and said second handle first end releasably interconnected.

17. The combination hand tool of claim 16, wherein said handle connection means comprises a handle locking pin.

18. The combination hand tool of claim 16, wherein said handle connection means comprises a ball detent.

19. A combination hand tool having at least two handles with at least three distinct positions of use, said handles releasably interconnected at a common point of rotation, comprising:

a) a first handle comprising a first end and a second end, said second end having a first jaw member;

b) a second handle comprising a first end and a second end, said second end having a second jaw member;

c) a pivot means operably interconnecting said first handle and said second handle proximate to said first and second jaw members, wherein in a first position of use said first jaw member and said second jaw member are operably opposed for grasping an object and in a second position of use said second handle is substantially a linear extension of said first handle to increase a total length of said combination hand tool, said combination hand tool capable of moving between said first position of use and said second position of use without disconnecting said first handle from said second handle;

d) a locking means operably interconnected to said first handle or said second handle to releasably secure said combination hand tool in said second position of use; and e) a handle release means interconnected to said pivot means, wherein said first handle may be disconnected from said second handle to provide a third position of use, wherein said first handle and said second handle of said combination hand tool may be used independently.

20. The combination hand tool of claim 19, further comprising a knife blade rotatably interconnected to said pivot means.

21. The combination hand tool of claim 20, wherein said knife blade further comprises an aperture positioned near an upper edge of said knife blade, wherein said knife blade is adapted for opening with the use of only one hand.

22. The combination hand tool of claim 20, wherein said knife blade further comprises a thumb stud positioned proximate to an upper edge of said knife blade, wherein said knife blade may be extended to a position of use with one hand.

23. The combination hand tool of claim 20, wherein said knife blade further comprises a thumb lobe positioned proximate to an upper edge of said knife blade, wherein said knife blade may be extended to a position of use with one hand.

24. The combination hand tool of claim 19, wherein said combination hand tool is adapted for traveling between said first position of use and said second position of use with the use of only one hand.

25. The combination hand tool of claim 19, further comprising a clip interconnected to said first handle or said second handle which is adapted for interconnecting said combination hand tool to an object such as a belt or trouser pocket.

26. The combination hand tool of claim 19, wherein said pivot means comprises an aperture extending therethrough which is adapted to receive a lanyard, key chain, rope or cable.

27. The combination hand tool of claim 19, further comprising a handle release/locking mechanism which releases said first handle and said second handle from said first position of use and permits said first and second handles to travel to said second position of use.

28. The combination hand tool of claim 19, wherein said first handle first end further comprises a first tool implement.

29. The combination hand tool of claim 28, wherein said first tool implement comprises a wrench.

30. A combination hand tool, comprising:

a) a first handle having a first end and a second end, said second end having a first jaw member;

b) a second handle having a first end and a second end, said second end having a second jaw member;

c) a pivot means rotatably interconnected to said first handle with said second handle, wherein said second handle may be rotated between a first position of use with the first and second jaw members operably opposed and a second position of use wherein the second handle is substantially an extension of said first handle, wherein a total length of said combination hand tool is increased; and d) at least one tool implement operably interconnected to said pivot means, wherein said tool implement may be rotated about said pivot means to a position of use.

31. The combination hand tool of claim 30, wherein said tool implement comprises a knife blade.

32. The combination hand tool of claim 31, wherein said knife blade further comprises an aperture extending through said knife blade proximate to an upper edge of said knife blade for opening said knife blade with the use of only one hand.

33. The combination hand tool of claim 31, wherein said knife blade further comprises a thumb stud positioned proximate to an upper edge of said knife blade, wherein said knife blade may be extended to a position of use with one hand.

34. The combination hand tool of claim 31, wherein said knife blade further comprises a thumb lobe positioned proximate to an upper edge of said knife blade, wherein said knife blade may be extended to a position of use with only one hand.

35. The combination hand tool of claim 30, wherein a knife blade cutting surface is substantially protected from exposure by at least a portion of said second handle when said combination hand tool is in said second position of use.

36. The combination hand tool of claim 30, wherein said combination hand tool may be opened and closed between said first position of use and said second position of use with the use of only one hand.

37. The combination hand tool of claim 30, further comprising a clip interconnected to said first handle or said second handle and which is adapted for interconnecting said combination hand tool to an object such as a belt or a trouser pocket.

38. The combination hand tool of claim 30, wherein said first handle first end has an interconnected first tool implement.

39. The combination hand tool of claim 38, wherein said first tool implement is a wrench.

40. The combination hand tool of claim 30, wherein said second handle first end further comprises a second tool implement.

41. The combination hand tool of claim 30, further comprising locking means for releasably securing said first handle to said second handle in said second position of use.

42. A combination hand tool, comprising:

a) a first handle having a first end and a second end, said second end having a first jaw member;

b) a second handle having a first end and a second end, said second end having a second jaw member and an aperture extending through said second handle proximate to said second jaw member;

c) a stud pivot pin interconnected on a first end to said first handle proximate to said first jaw member and extending through said aperture in said second handle, wherein said second handle may rotate with respect to said first handle between a first position of use with said first and second jaw members operably opposed and a second position of use wherein said second handle is extended to substantially the same longitudinal plane as said first handle to increase a total length of said combination hand tool; and d) a handle locking mechanism interconnected to said first handle or said second handle for releasably securing said first handle to said second handle in said second position.

43. The combination hand tool of claim 42, further comprising a knife blade rotatably interconnected to said stud pivot pin, wherein said knife blade may be extended to a position of use with the knife blade positioned in a plane which is substantially a linear extension of said first and second handles as shown in FIG. 4.

44. The combination hand tool of claim 42, wherein said combination hand tool is adapted for being opened and closed between said first position of use and said second position of use with the use of only one hand.

* * * * *